United States Patent [19]

Lin

[11] Patent Number: 5,073,228

[45] Date of Patent: Dec. 17, 1991

[54] STRUCTURE OF A CARTON SEALING STICKER AND CUTTER

[76] Inventor: Shuh-Chin Lin, No. 5, 35th Alley, 4th Lane, An-Lo Rd., Chung-Ho City, Taipei, Taiwan

[21] Appl. No.: 566,578

[22] Filed: Aug. 13, 1990

[51] Int. Cl.[5] ..... B32B 31/00

[52] U.S. Cl. ..... 156/523; 225/51; 225/72; 225/73; 156/527; 156/574; 83/175

[58] Field of Search ..... 225/6-10, 225/16, 19, 20, 22, 29, 30, 67, 68, 71, 17, 51, 72, 73; 156/523, 527, 530, 574, 577, 510; 83/175

[56] References Cited

U.S. PATENT DOCUMENTS

| | | | |
|---|---|---|---|
| 2,798,551 | 7/1957 | Polster | 225/19 |
| 3,306,806 | 2/1967 | Seropian | 156/523 |
| 4,804,437 | 2/1989 | Tirtoprodjo et al. | 156/523 |

*Primary Examiner*—David A. Simmons
*Assistant Examiner*—Robert Barker
*Attorney, Agent, or Firm*—Browdy and Neimark

[57] ABSTRACT

An improved carton sealing sticker and cutter, comprising a closed housing body including all elements, a cutter device which can press blade to extend out during tape delivery to cut it off, a safety device which controls blade not to extend out while tape is not delivered for use, a guide plate guiding tape delivery and positioning it and a tape sleeve ring having brake function engaged to the housing body. All elements are connected in the closed housing body. The end part of tape roll 23 sleeving tape sleeve ring is drawn out to stick to guide plate and extends appropriately long. Blade 24 of cutter device may extend out for cutting only in use state; safety device in ordinary time controls blade not to extend out to ensure safety.

1 Claim, 4 Drawing Sheets

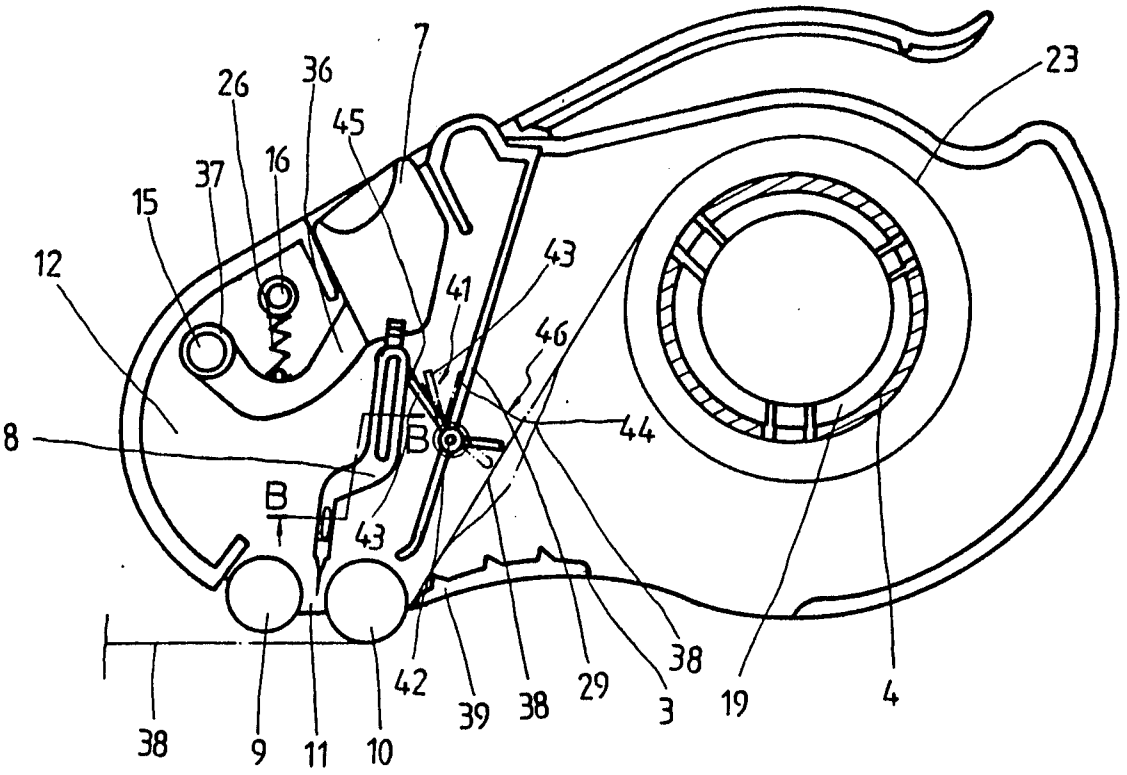
FIG. 6
FIG. 7
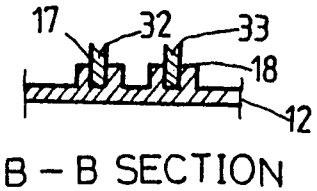

STRUCTURE OF A CARTON SEALING STICKER AND CUTTER

FIELD OF THE INVENTION

This invention relates to improved structure of a carton sealing sticker and cutter, and particularly to the improvements made on the housing body, cutter, guide plate and tape sleeve ring to provide more safety and convenience.

BACKGROUND OF THE INVENTION

A conventionally used carton sealing sticker and cutter is illustrated in FIG. 1. Wherein, housing body A comprises a tape sleeve ring B with two ends open and tape roll C sleeves it thereby. Tape head D running past guide axles E is stuck there and extends appropriately long. In use, the user secures grip handle F and tape sleeve ring B with extending of his fingers into the open two ends, sticks the adhesive face of tape head D to a carton's open end (not shown), then moves it back to deliver tape out of tape roll C past roller G to be pressed to seal the carton's open area. Jagged Cutter H which positions on above roller G then is applied to cut off out-drawn tape's rear end. The patentee of this carton sealing sticker and cutter has run production and sale of it for years but was urged by agents and customers to better design it. After survey and study, this carton sealing sticker and cutter is found with defects:

1. The jagged cutter H is fixedly positioned at the front and thus easily leads to human skin harm, and the cut end of tape would be untidy.
2. The adhesive face of tape head D and all tape to extend must make face contact with guide axles E, that as a result affects tape's adhesive nature.
3. While not in use, the adhesive face of outwardly extended tape head D is easy to pollute and might loose its adhesive nature.
4. Tape sleeve ring B is loosely sleeved with tape roll C so that tape roll C may reverse freely and even drop off.

OBJECTS OF THE INVENTION

To overcome the above-said shortcomings, the present invention provides an improved kind of carton sealing sticker and cutter of which the features are:

1. The cutter has a cone-shaped cutting edge and is completely hidden in the housing body. In use, pushing a press button will drive it out to do cutting and, afterwards, return back to the inside of housing body on its own. While not in use, even pushing that button will not cause cutter to come out. Such fashioned cutter not only gives tape a neat cut but no longer harms human skin so easily.
2. The adhesive face of tape makes a thread contact with guide plate to lessen influence to its adhesive nature.
3. Most of the tape end is concealed in the housing body so dust pollution does not take place easily.
4. The tape sleeve ring is provided with resilient means to engage a cover plate. Therefore, friction force caused therebetween may stablize tape roll.

SUMMARY OF THE INVENTION

An improved carton sealing sticker and cutter comprises an enclosed housing body, a cutter device, a safety device in control of cutter extension, a guide plate to guide tape delivery and position tape and a tape sleeve ring of brake function connected to housing body. All elements are connected in the housing body. A tape roll sleeves the tape sleeve ring and the end part of it is drawn out to stick to the guide plate and extend appropriately long. In use, after having tape head pasted to one end of a carton's seal opening, the user moves it back and presses the delivered tape to seal the carton's seal opening. Once press button is pushed by finger, cutter device will extend to cut off the sealing tape's rear end.

BRIEF DESCRIPTION OF THE DRAWINGS

FIG. 6 shows the invention is ready for use, in particular about the safety device to act;

FIG. 7 is a sectional view taken along B—B line of the invention in FIG. 6.

SPECIFIC DESCRIPTION

Figure 1:
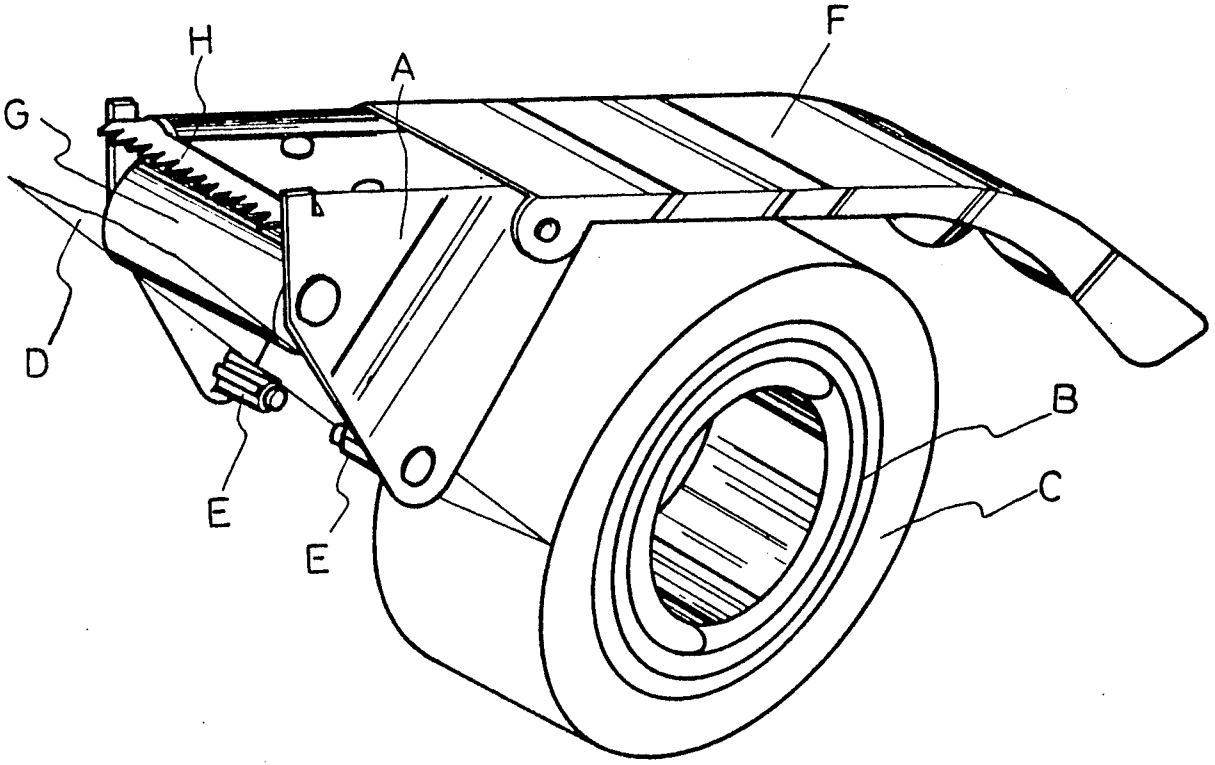
FIG. 1 (PRIOR ART)
FIG. 1 is a perspective view of a conventionally used carton sealing sticker and cutter.
Figure 5:
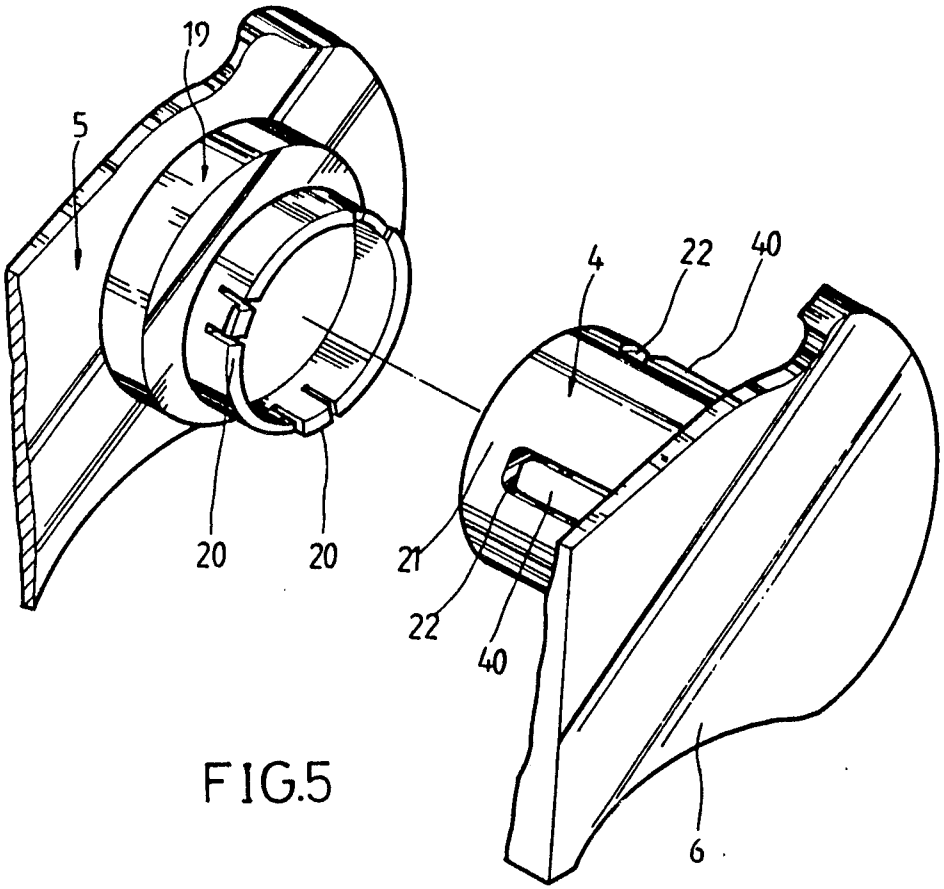
FIG. 5 shows construction of the tape sleeve ring of the invention.
Figure 2:
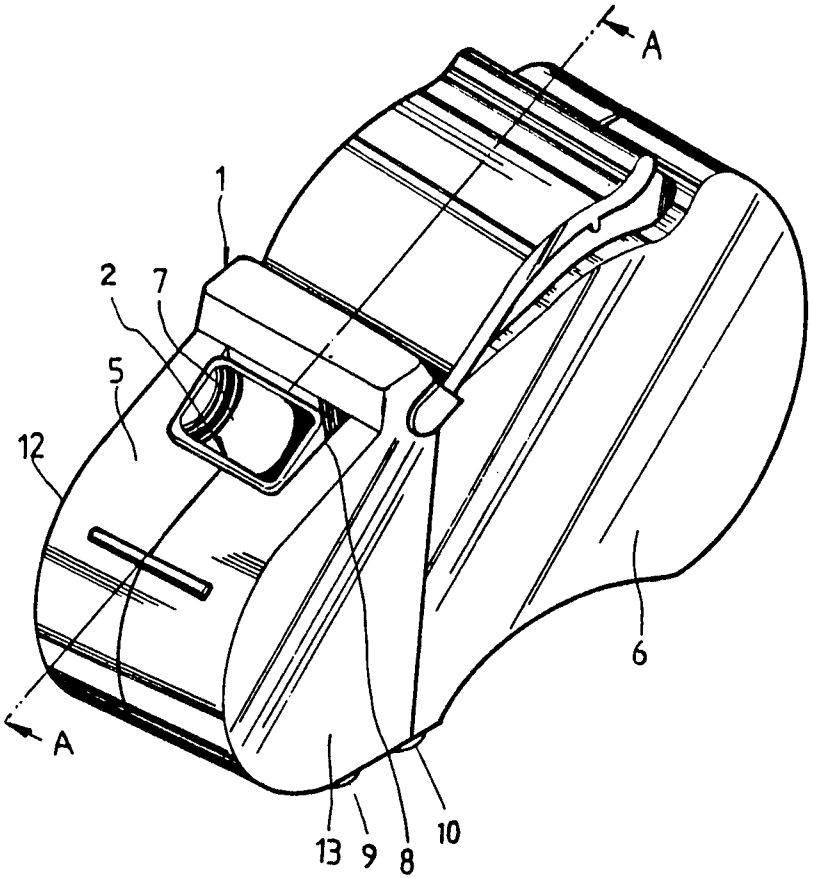
FIG. 2 is an appearance perspective view of the invention.
Figures 3, 4:
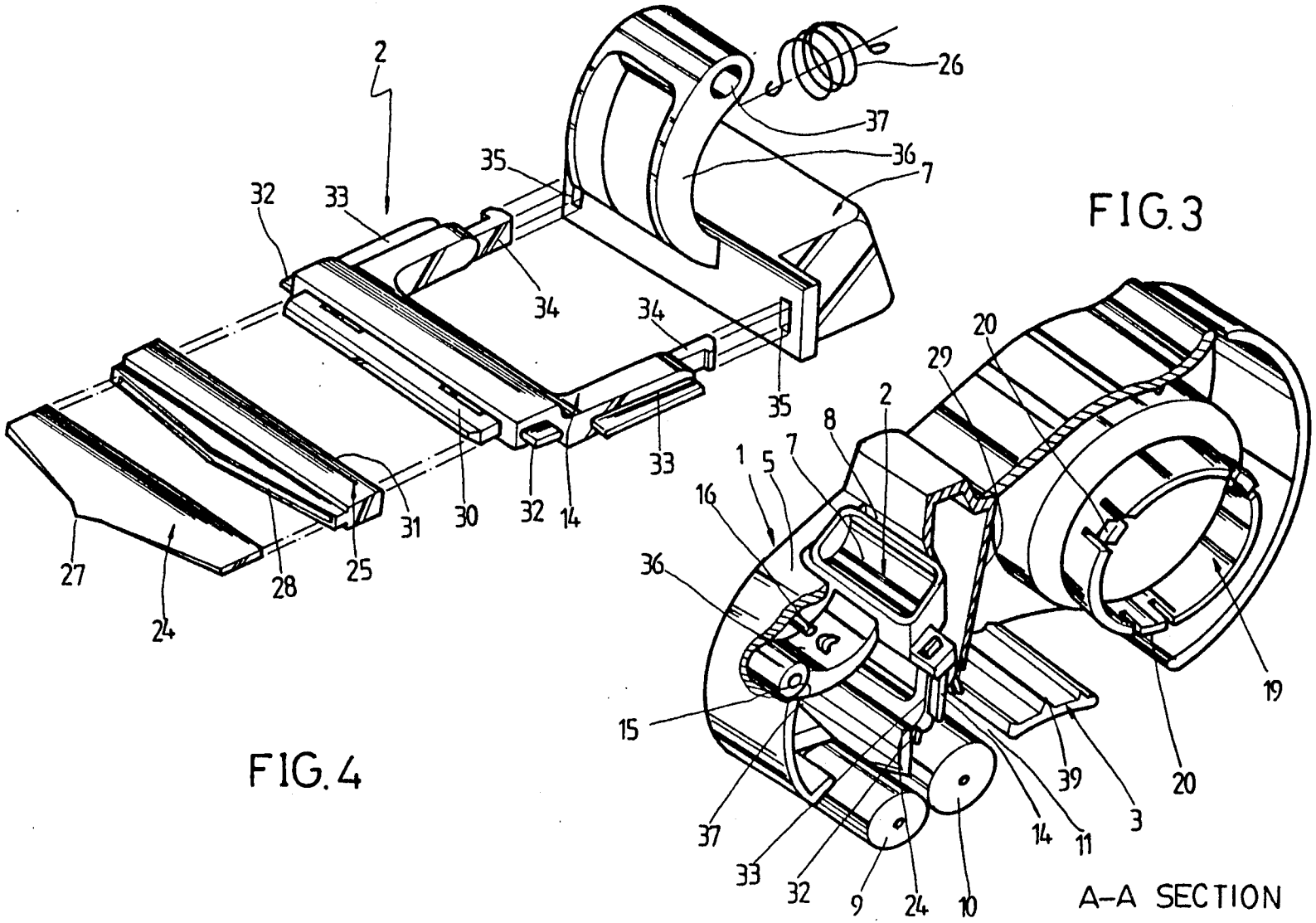
FIG. 3 is a sectional view taken along A—A line of the invention in FIG. 2.
FIG. 4 is an exploded view of the cutter device of the invention.

Firstly referring to FIGS. 2, 3, this invention comprises housing body 1, cutter device 2, guide plate 3 and tape sleeve ring 4 involved in improvement. All remaining parts are of the same structure as the conventionally used device, so that further description is omitted. Now, description of the improved elements are as follows, with reference to the drawings:

As FIGS. 2, 3 and 5 show, housing body 1 comprises basic frame 5 and cover plate 6. Basic frame 5 has an arcuate front part provided with mount hole 8 where press button 7 of cutter device is located, and vacancy 11 is provided in its lower part thereof for front and back rollers 9, 10 to extend locally, and on the inside of the side walls thereof, there are provided slideways 17, 18 (as FIG. 7 shows) for holding cutter support 14 as well as pivot 15 and suspension bar 16 (as FIGS. 3, 6 show) which pivotally connect press button 7 and link cutter device 2. A partition board 29 divides basic frame 5 into the front area and back area; safety device 41 is also arranged on partition board 29 to control extension of the cutter. In the back area of basic frame 5, there are provided a guide plate 3 behind vacancy 11 and tape sleeve ring 4 in the central area of the back side wall. Tape sleeve ring 4 comprises connection base 19 which is a hollow short barrel on which the peripherial walls are provided with three resilient hooks to meet with the catch holes 22 of barrel seat 21 perpendicularly connected to the inside of cover 6, for tape tape roll 23 to sleeve thereon (as FIGS. 5, 6 show).

As FIGS. 3, 4 and 6 show, cutter device comprises: blade 24, blade seat 25, blade support 14, press button 7, extensible spring 26 and safety device 41. Connected between side walls 12, 13 of the basic frame front area, blade 24 aiming at the gap between front and back rollers 9, 10 may extend out therefrom to cut off tape. Blade 24 is a little bit wider than the tape and has a cone-shaped cutting edge through point 27 of which the cutting action would go to spread to the two sides of tape slowly till completion, and is fixed in the offering flute 28 of blade seat 25 by means of insertion of its upper half part therto. Blade seat 25 is a flat jacket comprising offering flute 28 of a size adapted to blade 24 in the lower part and groove 31 in the upper part to which flange 30 of blade support 14 inserts and is engaged thereby. Blade support 14 is somewhat U-shaped with packing plates 32, 33 which are arranged to insert into slideways 17, 18 on side walls 12, 13 to slide to and fro (as FIG. 7 shows). And on two sides of blade support 14, there are buckles 34 on each side provided to meet sockets 35 on two sides of press button 7. Press button 7 comprises a suspension arm 36, an axis hole 37 which connects pivot 15 arranged between side walls 12, 13 of the basic frame front area, and an extensible spring 26 which links its top face thereof and is hung up by connection to suspension bar 16. In this way, as press button 7 is pushed down, blade 24 will be driven down too and retreat immediately upon release of press button 7.

As FIG. 6 shows, safety device 41 is pivotedly connected to pivot pin 42 provided on partition board 29, which comprises operation board 43, torsional spring 44 and raised part 45 on the back of blade support 14. Wherein, operation board 43 having a central hole is pivotally mounted on pivot pin 42 so that operation board 43 may turn around it. Torsional spring 44 is also pivotally mounted on pivot pin 42 so that one arm of spring 44 is biased against the front part of partition board 29 and the other arm is biased against the front part of operation board 43. The spring force of torsional spring 44 thereby maintains the front part of operation board 43 beneath raised ridge 45 on the back of blade support 14 to prevent blade support 14 from moving down. The rear end of operation board 43 extends into the back area of basic frame 5; when not in use, the rear end does not engage loosened tape 38 (dotted line) while the front end of operation board 43 is maintained beneath raised ridge 45 of blade support 14. In use, tape 38 gets tight (solid line) and is drawn out in a direction as arrow 46 indicates around roller 10. The tightened tape 38 as it is being drawn out around roller 10 engages the rear end of operation board 43, as shown in FIG. 6 as tape 38 moves in engagement with the rear end of operation board 43 the spring force exerted to the front part of operation board 43, is overcome and operation board 43 turns around pivot pin 42 some angle degree and, is released from under raised ridge 45 of of blade support 14 (as dotted line shows). In this way, cutter device 2 may extend out once press button 7 is pushed down; while not in use, operation board 43 which then loses friction force caused from tape 38 may return back to beneath raised part 45.

As FIGS. 3, 6 show, guide plate 3, arranged behind vacancy 11, is slightly arcuate in shape and comprises raised edges 39 to guide tape 38 to smoothly deliver out (as FIG. 6 shows).

As FIGS. 3, 5 and 6 show, tape sleeve ring 4 is a hollow barrel, one end of which is perpendicularly connected to the inside of cover 6 and on the peripherial walls of the barrel body of which are provided resilient pieces 40 relatively outward developed to avoid any turning or reverse of tape roll 23 while sleeves thereon. The other end of tape sleeve ring 4 is provided with catch holes 22 by means of which to engage to connection base 19 of the central area of back side wall of basic frame 5 having resilient hooks 20 for adaption and cover by cover 6.

I claim:

1. The improved structure of a carton sealing sticker and cutter, comprising:

a housing body comprising a basic frame and a cover, said basic frame comprising an arcuate front part with a mount hole on the upper wall thereof for mounting of a press button of cutter device, a vacancy in the lower part for locally extending a front and a back roller therefrom and the inside of the two side walls provided with slideways, a pivot and a suspension bar therebetween to link said cutter device; a partition board dividing the frame into a front and back area; a guide plate arranged behind said vacancy; in the central area of the back side wall, a connection base of a tape sleeve ring comprising a hollow short barrel provided with three resilient hooks on its peripherial walls thereof to meet with catch holes of the barrel seat of said tape sleeve ring upon engagement;

a cutter device comprising a blade, a blade seat, a blade support, a press button and an extensible spring connected between two side walls of said basic frame front part wherein said blade is aimed at the gap of between said front and back rollers; said blade being a little bit wider than tape with a cone-shaped cutting edge and joined to said blade seat by inserting its upper half part into an offering flute provided in said blade seat lower half part; said blade seat being a flat jacket with a groove in its upper part in which the flange of end part of said blade support inserts to be connected thereby; said blade support being somewhat U-shaped with packing plates on its two sides which insert into said slideways on said housing body two side walls and buckles on the ends of its two sides which insert sockets provided on two sides of said press button to link and position them thereby; said press button comprising a suspension arm in the front part and an axis hole at the top end by which to be pivoted on said pivot connected between two side walls of said housing front part and being hung up by said suspension bar so that if said press button is pressed down, said blade may move down too but retreats immediately upon release of it;

a safety device pivoted on a pivot pin in said partition board and comprising an operation board, a torsional spring and a raised part on the back of said blade support; said operation board having a central pivot hole to sleeve said pivot pin; said torsional spring which too sleeves said pivot pin having one arm of itself resist against the front part of said partition board and the other arm against the front part of said operation board to enable said operation board to counter-balance beneath said raised part of said blade support to prevent downward movement of said blade; said operation board's rear part extending into said housing body back area wherein the tape when tightened may contact the rear end of said operation board and the generated friction force therebetween thus may force the front end of said opertion board to depart from said raised part of said blade support;

a guide plate being slightly arcuate in shape and arranged behind said vacancy and provided with raised edges for guiding tape delivery;

a tape sleeve ring being a hollow barrel one end of which is perpendicularly connected to the inner wall of said cover and, on the barrel body peripherial walls, comprising a few resilient pieces slightly outward developed and catch holes to which said three resilient hooks provided on said connection base of said housing body's back side wall are engaged in order for tape roll to sleeve thereon, and covered by said cover;

with the above-described elements, this improved carton sealing sticker and cutter may overcome shortcomings of the conventionally used device.

* * * * *